US007694642B2

(12) United States Patent
De Vroome

(10) Patent No.: US 7,694,642 B2
(45) Date of Patent: Apr. 13, 2010

(54) DEVICE FOR APPLYING A LIQUID MIXTURE TO WEB-SHAPED PRINTING MATERIAL

(75) Inventor: Clemens Johannes De Vroome, Beugen (NL)

(73) Assignee: Goss Contiweb B.V., Boxmeer (NL)

( * ) Notice: Subject to any disclaimer, the term of this patent is extended or adjusted under 35 U.S.C. 154(b) by 0 days.

(21) Appl. No.: 12/079,651

(22) Filed: Mar. 28, 2008

(65) Prior Publication Data

US 2008/0178798 A1 Jul. 31, 2008

Related U.S. Application Data

(63) Continuation of application No. 10/764,774, filed on Jan. 26, 2004, now abandoned.

(60) Provisional application No. 60/443,706, filed on Jan. 30, 2003.

(30) Foreign Application Priority Data

Jan. 30, 2003 (DE) ..... 103 03 849

(51) Int. Cl.
*B05C 11/00* (2006.01)

(52) U.S. Cl. ..... 118/46; 118/69; 118/101

(58) Field of Classification Search ..... 118/46, 118/69, 101, 694, DIG. 1, 263, 684, 244, 118/258; 101/488, 416.1, 424.2
See application file for complete search history.

(56) References Cited

U.S. PATENT DOCUMENTS

| | | | | |
|---|---|---|---|---|
| 4,637,341 | A | 1/1987 | Switall | 118/694 |
| 5,075,128 | A | 12/1991 | Gnuechtel et al. | 427/8 |
| 5,641,544 | A | 6/1997 | Melancon et al. | 427/331 |
| 6,735,883 | B1 * | 5/2004 | Bria et al. | 34/444 |
| 6,892,642 | B2 * | 5/2005 | De Vroome | 101/487 |
| 7,065,901 | B2 * | 6/2006 | de Vroome | 34/392 |
| 2002/0106444 | A1 | 8/2002 | Menet et al. | 427/8 |

FOREIGN PATENT DOCUMENTS

| | | |
|---|---|---|
| DE | 69521531 | 11/1997 |
| DE | 19650125 | 6/1998 |
| JP | 8-52857 | 2/1994 |
| WO | WO 02/093269 | 11/2002 |

* cited by examiner

*Primary Examiner*—Brenda A Lamb
(74) *Attorney, Agent, or Firm*—Davidson, Davidson & Kappel, LLC

(57) ABSTRACT

A printing press is provided. The printing press includes at least one printing unit for printing a web-shaped printing material and a device for applying a liquid mixture of a silicone oil concentrate and at least water to the web-shaped printing material. The device includes reservoir for the silicone oil concentrate, a supply source for the water, a mixing tank for the silicone oil concentrate and the water, an applicator for transferring the liquid mixture onto the printing material. The applicator has at least one container for the liquid mixture. The device also includes a buffer tank for the silicone oil concentrate separate from the mixing tank. The buffer tank receives the silicone oil concentrate from the reservoir. The printing press also includes a cooling roll for the web-shaped printing material.

4 Claims, 1 Drawing Sheet

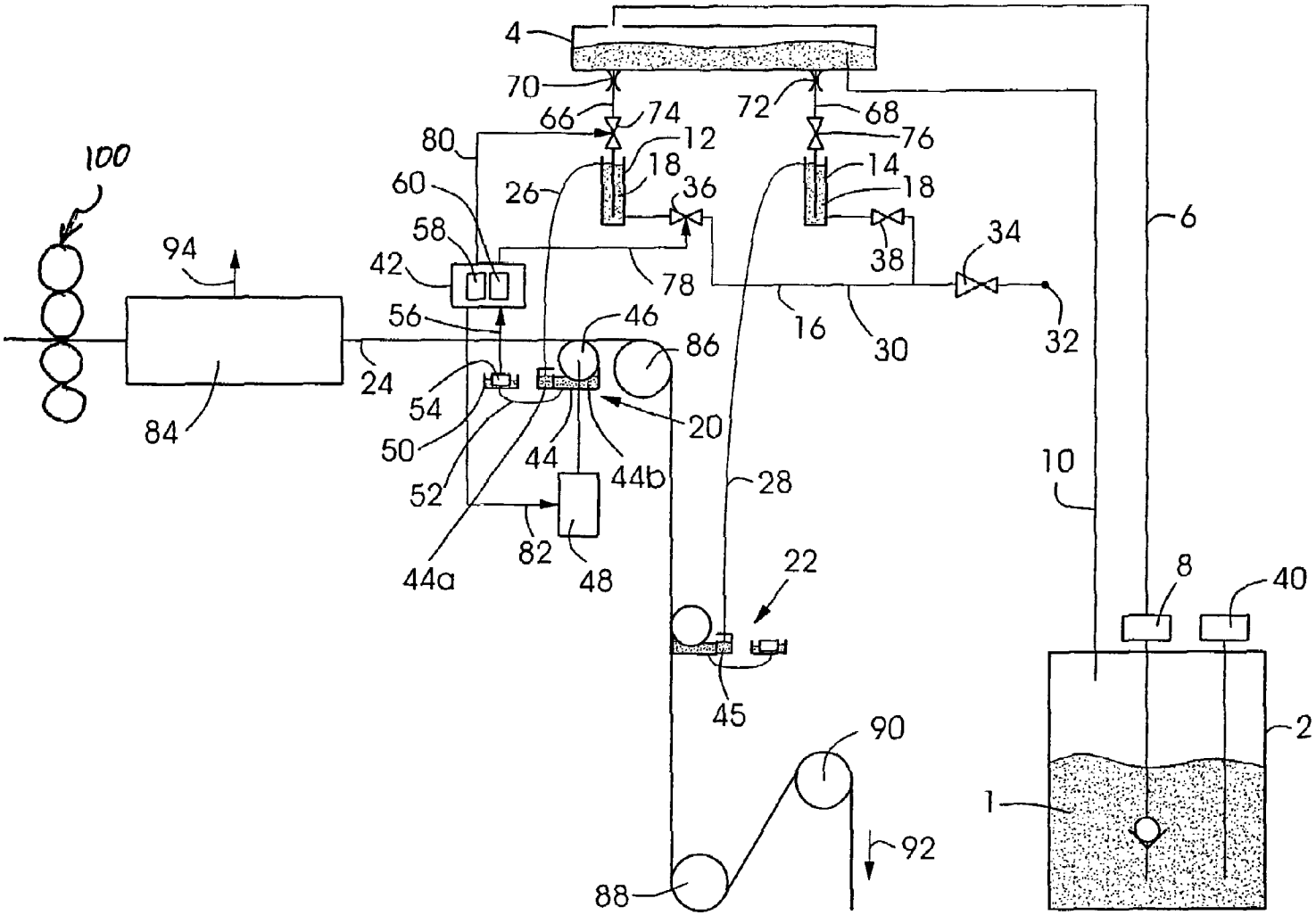
1
2
4
6
8
10
12
14
16
18
20
22
24
26
28
30
32
34
36
38
40
42
44
44a
44b
45
46
48
50
52
54
56
58
60
66
68
70
72
74
76
78
80
82
84
86
88
90
92
94
100

DEVICE FOR APPLYING A LIQUID MIXTURE TO WEB-SHAPED PRINTING MATERIAL

This claims the benefit of U.S. Provisional Patent Application No. 60/443,706 and German Patent Application No. 103 03 849, both filed Jan. 30, 2003 and hereby incorporated by reference herein.

CROSS REFERENCE TO RELATED APPLICATIONS

This is a continuation of U.S. patent application Ser. No. 10/764,774, filed on Jan. 26, 2004.

BACKGROUND

The present invention relates to a device for applying a liquid mixture of a first liquid and at least one second liquid to web-shaped printing material.

In rotary offset printing presses, a paper web is typically unrolled off a supply roll and guided through a plurality of printing units which print the web in multiple colors on both sides using the wet offset method. For drying the web and the wet printing ink, the web is guided through a hot air dryer in which water and volatile solvents of the printing ink vaporize. For setting the liquid ink, the web is subsequently guided over cooling rolls of a cooling roll stand, the cooling rolls being flushed by a cooling medium. Finally, for producing the finished printing products, the web is fed to a folding machine which may fold and cut the web in different configurations. The finished products are then oftentimes supplied to a shipping room.

In order to prevent a buildup of printing ink on guide elements for the web, a silicone oil emulsion may be applied to the dried web in known devices. At the same time, the water content of the emulsion makes desired rewetting of the web after drying possible.

A device for applying a silicone oil emulsion to a paper web is known from U.S. Pat. No. 4,637,341. The device has a buffer and mixing tank which is connected to a reservoir for silicone oil concentrate via a supply line. The buffer and mixing tank is used, among other things, for buffering the silicone oil emulsion since, prior to reaching a lowest fill level, the reservoir is exchanged for another reservoir so that, for a certain time period of the exchange, the supply of silicone oil concentrate is not possible. In addition, the buffer and mixing tank is connected to a water source so that the tank may be used not only for buffering, but also for mixing a desired silicone oil emulsion. The mixture so produced is conveyed via a heat exchanger for heating the mixture to a trough of a respective applicator roll; the applicator roll scoops the mixture out of the trough and applies it on a paper web.

A control unit is connected to an upper sensor and a lower sensor which monitor the fill level of the buffer and mixing tank. When the fill level reaches the level of the lower sensor, the control unit opens a valve in the water supply until the fill level reaches the level of the upper sensor; then the control unit closes the valve again. Simultaneously, a desired quantity of silicone oil concentrate is delivered from the reservoir into the buffer and mixing tank so that a silicone oil emulsion having the desired mixing ratio is produced.

Several disadvantages are associated with the known device. For example, no silicone oil concentrate is buffered, but rather a silicone oil emulsion having a desired mixing ratio. This may result in the fact that the fill level of the buffer and mixing tank reaches the lowest level, replenishment of silicone oil concentrate not being immediately possible since, at the same time, the reservoir may also have reached its lowest fill level. Moreover, the buffer and mixing tank must have very large dimensions since the emulsion is used up much more rapidly than the concentrate.

Furthermore, due to the large dimension of the buffer and mixing tank, it is not possible in the known device to change the mixing ratio in the buffer and mixing tank within a short response time, in order to adjust the mixing ratio to a new print job, for example.

The known device also does not allow the application of silicone oil emulsion of differing mixing ratios on both sides of the paper web. To achieve this, the known device would have to be used separately on both sides, so that there would be a separate buffer tank for each side.

Finally, the operator is unable to predetermine the desired water-to-silicone oil ratio of the mixture, in particular separately for both sides of the web.

BRIEF SUMMARY OF THE INVENTION

One object of the present invention is to provide a device and a method for applying a liquid mixture to web-shaped printing material which overcome the disadvantages of the related art.

A further or alternative object of the present invention is to provide a device and a method for applying a liquid mixture to web-shaped printing material which, using a simple construction and being cost-effective, enable an interruption-free supply of the liquid mixture.

A further or alternative object of the present invention is to provide a device and a method for applying a liquid mixture to web-shaped printing material which, using a simple construction and being cost-effective, enable a continuous or quasi-continuous or intermittent supply of the first liquid, the second liquid, and/or the liquid mixture.

A device according to the present invention for applying a liquid mixture, a silicone oil emulsion for example, a first liquid, silicone oil concentrate for example, and at least one second liquid, water for example, to web-shaped printing material, a paper web for example, having a reservoir for the first liquid, a supply source for the second liquid, a mixing tank for the first liquid and the second liquid, an applicator for transferring the liquid mixture onto the printing material, the device having at least a container for the liquid mixture, is characterized in that a buffer tank separated from the mixing tank is provided for the first liquid.

The term "separated" should be understood in the following that the mixing tank and the buffer tank represent two separate tanks or containers, each having a space in which the appropriate liquid is accommodated. The tanks may be situated physically apart from one another, or close to one another, or adjacent to one another. The two tanks may also form a common container which is divided into the two tanks by at least one partition.

The division or separation of the mixing tank and the buffer tank according to the present invention allows interruption-free supply of the applicator with the liquid mixture to be ensured in an advantageous manner. The size of the buffer tank may advantageously be reduced, likewise the size of the mixing tank.

Moreover, the device may have a supply line from the buffer tank to the mixing tank including a valve which may be operated by a control unit and/or a regulating unit in such a way that a continuous, or quasi-continuous, or intermittent flow of the first liquid is produced.

The terms "continuous," "quasi-continuous," and "intermittent" should be understood here as follows:

continuous: the liquid or the liquid mixture flows without interruption; however, it may vary in its flow rate;

quasi-continuous: the liquid or the liquid mixture flows essentially continuously, optionally with short interruptions;

intermittent: the liquid or the liquid mixture flows in intervals, with periodic or non-periodic interruptions, for example. The time intervals when flow occurs, as well as those when flow does not occur, may vary in their duration.

The percentage composition of the liquid mixture may advantageously be variable, i.e., it may be influenced, a very short response time being achievable due to the small size of the containers, so that, even during operation, an adjustment to modified parameters of the current print job is possible, for example.

Furthermore, the control unit and/or regulating unit may operate an appropriate valve in a supply line from the supply source for the second liquid to a first and a second mixing tank in such a way that a continuous, or quasi-continuous, or intermittent flow of the second liquid is produced.

The second liquid, which preferably constitutes the larger proportion in the liquid mixture, advantageously is supplied from a supply source directly to the mixing tank, i.e., without buffering, the supply source being able to deliver the second liquid in a quasi-endless manner, out of a supply network, for example.

In addition, it is possible that the applicator has a float element or a fill level sensor which is connected to the control unit and/or regulating unit for signal and/or data transmission, of the fill level in particular.

Monitoring the fill level in the applicator's container makes it advantageously possible to control or regulate the supply of the two liquids to the mixing tank in such a way that a continuous, or quasi-continuous, or intermittent flow of the two liquids is generated, allowing the size of the respective tanks to be reduced.

In a further embodiment, the applicator's container is designed as a trough and an applicator roll scoops the liquid mixture from the trough and transfers it onto the printing material.

The applicator roll may be driven by a motor which is controlled and/or regulated in particular by the control unit and/or regulating unit in such a way that the rotational speed of the applicator roll is modifiable.

At a given percentage composition of the liquid mixture, the quantity of transferred liquid mixture may be influenced by modifying the rotational speed of the roll.

In one embodiment of the present invention, the mixing tank has a smaller volumetric capacity than the buffer tank. The capacity of the mixing tank may be approximately one liter, for example, and the capacity of the buffer tank may be approximately ten liters, for example.

A method according to the present invention for applying a liquid mixture of a first liquid and at least one second liquid to web-shaped printing material, a reservoir accommodating the first liquid, a supply source delivering the second liquid, a mixing tank receiving and mixing the first liquid and the second liquid, an applicator, having at least one container for the liquid mixture, transferring the liquid mixture onto the printing material, is characterized by the following method steps:

receiving the first liquid in a buffer tank for the first liquid which is separated from the mixing tank, and feeding the first liquid from the buffer tank to the mixing tank in a controlled and/or regulated manner.

Moreover, a control unit and/or regulating unit may operate at least one valve in such a way that a continuous, or quasi-continuous, or intermittent flow of the first liquid and/or the second liquid to the mixing tank is produced.

A method according to the present invention for wetting a printing material web, a water-silicone oil concentrate-mixture being applied on the web, is characterized in that the proportion or allotment of water and the proportion or allotment of silicone oil concentrate are separately selectable—e.g., adaptable to the web speed and/or the web width.

BRIEF DESCRIPTION OF THE DRAWINGS

The present invention is described in greater detail below with reference to Drawing FIG. 1.

FIG. 1 shows a device according to the present invention for applying a liquid mixture of a first and at least a second liquid to web-shaped printing material.

DETAILED DESCRIPTION

A material web 24, in particular a printing material web 24, made of paper, for example, is, after being unrolled and imprinted in printing units 100, guided in moving direction 92 through a hot air dryer 84 and, for cooling, subsequently over cooling rolls 86, 88, and 90 which are flushed with a cooling medium.

Due to the hot air in dryer 84, which should vaporize solvents of the printing ink, moisture 94 is also removed from web 24 so that it may be necessary to subsequently rewet web 24, at least partially.

Cooling of web 24 results in setting of the printing ink; however, a printing ink buildup on guide rolls or guide surfaces in subsequent press components, in the folding machine, for example, may occur nevertheless. This ink buildup may be countered by applying silicone oil on web 24.

First liquid 1, silicone oil concentrate 1 in this case, is accommodated in a reservoir 2. This reservoir 2, for example, may accommodate a sufficient quantity of silicone oil concentrate for an entire print job so that an exchange of reservoir 2 is only very seldom necessary, after several print jobs, for example. The reservoir may be designed as a barrel, for example. Instead of storing a silicone oil mixture, it is advantageous to store the silicone oil concentrate, since smaller reservoirs may be used.

Reservoir 2 is connected to a buffer tank 4 for first liquid 1, assumed in the following in an exemplary but not restrictive manner to be silicone oil concentrate 1, via a supply line 6. Line 6 has a pump 8 which conveys silicone oil concentrate 1 from reservoir 2 to buffer tank 4 in a desired quantity.

Moreover, buffer tank 4 is connected to reservoir 2 via an overflow line 10 so that excess silicon oil concentrate 1 conveyed into the buffer tank may flow back into the reservoir. A constant fill level is maintained in buffer tank 4, as long as reservoir 2 contains sufficient silicone oil concentrate 1 which is being conveyed continuously, quasi-continuously, or intermittently by pump 8.

A sensor-controlled warning device 40 which monitors the fill level of reservoir 2 for reaching a lowest level may indicate an imminently necessary exchange of reservoir 2 to the operator, for example. At the moment of reaching the lowest fill level, it is also possible to automatically switch over to a second reservoir.

Furthermore, the device according to the present invention has a mixing tank 12 and a mixing tank 14 in which silicone oil concentrate 1 is mixed with second liquid 16, assumed in the following in an exemplary but not restrictive manner to be water 16, to form a liquid mixture 18, a silicone oil emulsion in this case.

Water 16 is supplied from a supply source 32 to mixing tanks 12 and 14 via a supply line 30; a pressure control valve 34 initially modifies the pressure of water 16 of supply source 32, by reducing it, for example, and subsequently calibrated valves 36 and 38 control the water flow 16 to the two mixing tanks 12 and 14, respectively, by opening and closing. The combined use of a pressure control valve 34 and a calibrated valve 36 or 38 makes the water flow (quantity per time) controllable or regulatable, and thus adjustable.

The water pressure is kept constant by pressure control valve 34 so that a constant pressure is present at the inlet side of valves 36, 38. Valves 36 and 38 may be controlled electrically and may be designed as solenoid valves including an actuator coil so that they increase, reduce, or interrupt the water flow 16 proportionally to the electric control signal.

Silicone oil concentrate 1 is supplied to mixing tanks 12, 14 via supply lines 66, 68 which each have a flow limiter 70, 72 and an electrically controllable valve 74, 76, solenoid valves including an actuator coil, for example. Controlled opening of a valve 74 or 76 allows for a certain quantity or a certain flow of silicone oil concentrate 1 to flow into mixing tanks 12 or 14.

At a given setting, flow limiters 70, 72 allow for a constant and thus known flow of silicone oil concentrate, the flow essentially being independent from the emulsion viscosity.

As shown in the example of FIG. 1, the flow of silicone oil concentrate 1 may take place solely due to gravity which means, for example, that the use of an extra pump may be dispensed with if buffer tank 4 is situated higher than mixing tanks 12, 14. The selected, constant height of fall and the degree of opening of flow limiters 70, 72 and optionally valves 74, 76 determine the flow in supply lines 66, 68. Thus, a constant pressure is present at the inlet side of valves 74, 76.

Valves 36, 38 as well as valves 74, 76 may be periodically controlled with a selectable period and length of opening time so that the flow is accurately adjustable.

Mixing tank 12 supplies an applicator 20, which applies liquid mixture 18 to a first side of web 24 via a supply line 26, and mixing tank 14 supplies an applicator 22, which applies liquid mixture 18 to a second side of web 24 via a supply line 28. The mixing tanks have a small volume so that concentration variations, caused by opening and closing of valves 34, 36, 74, 76, are quickly attenuated.

The pressure of the water supplied may be utilized to stir the water with the silicone oil concentrate without other means, such as a stirrer, for example.

The cooperation of the known, constant height of fall of the concentrate, the known degree of opening of flow limiters 70, 72, and the known control of valves 74, 76, 34, 36 with regard to period and length of opening time makes the control or regulation of the concentrate quantity supplied possible in a simple way. For example, pumps are thus not necessary, and neither is a measuring device for measuring the flow through.

As an example, only the application on the first side, for example the bottom side, of web 24 is described in the following, it being assumed that the same is also true for the second side of web 24, in particular that elements not shown of the device according to the present invention are also assumed to exist with regard to the application to the second, opposite and, for example, top side.

Applicator 20 includes a container 44, a trough 44, for example, which receives liquid mixture 18, and from which an applicator roll 46 scoops liquid mixture 18 and applies it to the appropriate side of web 24. For this purpose, applicator roll 46 is driven by a motor 48 which determines the rotational speed of applicator roll 46 and thus the quantity of liquid mixture 18 transferred and applied to web 24. More liquid mixture 18 is transferred at higher rotational speed, versus less liquid mixture at lower rotational speed.

Trough 44 has two sections 44*a* and 44*b*, liquid mixture 18 being fed into section 44*a* from where liquid mixture 18 flows evenly over a partition between the two sections and arrives in section 44*b*. Applicator roll 46 submerges into section 44*b* and takes up liquid mixture 18. It may be ensured in this way that roll 46, across its axial extension, takes up and transfers liquid mixture 18 evenly, since section 44*b* is always filled evenly in its axial extension, while section 44*a* is being filled via supply line 26 at one or several points.

A regulating and/or control unit 42, for the sake of simplicity referred to below as controller 42, monitors the fill level of liquid mixture 18 in trough 44 of applicator 20. Trough 44 is connected to a measuring vessel 50 via a communicating line 52, a float element 54 being situated in vessel 50 which, continuously or in intervals, for example, transmits the instantaneous fill level in trough 44 to controller 42 in the form of a signal and/or in the form of a data stream via a signal line and/or data line 56.

Controller 42 includes a memory unit 58 in which the following data is stored:

concentration K (30% for example) of the silicone oil concentrate in reservoir 2;

instantaneous web speed V (10.5 m/s for example) of web 24;

web width W (1905 mm for example) of web 24 currently being processed;

the setpoint value for water application WA1 (1900 mg/m$^2$ for example) onto the first side of web 24;

the setpoint value for water application WA2 (1900 mg/m$^2$ for example) onto the second side of web 24;

the setpoint value for silicone oil application SA1 (25 mg/m$^2$ for example) onto the first side of web 24:

the setpoint value for silicone oil application SA2 (60 mg/m$^2$ for example) onto the second side of web 24.

Values WA1, WA2, SA1, and SA2 may have been determined empirically; for certain print jobs (e.g., parameters for printing material, printing inks, wetting agent, surface coverage, dry treatment, web temperature) the best values for WA1, WA2, SA1, and SA2 have been determined manually and, for subsequent presetting, have been stored in memory unit 58 together with the print job number. However, it is also possible that, in a certain print job (e.g., parameters for printing material, printing inks, wetting means, surface coverage, dry treatment, web temperature), a processor 60 of controller 42 determines the best possible values for WA1, WA2, SA1, and SA2, using an algorithm, and stores them in memory unit 58.

From the values of WA1, WA2, SA1, and SA2, processor 60, knowing the values for K, V, and W, and based on an algorithm or a table (LUT), may determine with which rotational speed applicator roll 46 must be driven and/or what quantity or what flow rate of silicone oil concentrate 1 and water 16 must continuously, quasi-continuously, or intermittently be fed to the mixing tank by controlling valves 36, 38, and 74, 76.

In the event that the flow through valves 36, 38, 74, and 76 in their fully opened state is also stored in memory unit 58, the algorithm is able to determine the necessary opening times or opening intervals of the valves.

In the event that the flow through valves 36, 38, 74, and 76 at their given degree of opening is stored in memory unit 58, the algorithm is able to determine the necessary degree of opening of the valves for certain time intervals.

Valves 36, 38, 74, and 76 are generally calibrated so that the flow through the valves is known and may be obtained from a valve data sheet, for example.

Valves 74, 76 are preferably operated intermittently, i.e., fully opened and closed again in sequence, for example; the frequency and/or the opening time may be variable. Valves 36, 38 are preferably operated continuously or quasi-continuously with a variable degree of opening.

For opening and closing of valves 36 and 74, controller 42 is connected to the same via signal lines or data lines 78 and 80, respectively. Controller 42 controls motor 48 via a signal and/or data line 82.

The values of SA1 and SA2 in the aforementioned example are evidently different which may occur, for example, when both sides of web 24 have different surface ink coverage, or when one side of web 24 comes into contact with more guide rolls or guide surfaces, a fold guide for example, than the other side. It may be reasonable in both cases to apply more silicone oil to the appropriate side of web 24, but to keep the water quantity constant for both sides. In such a case, the device according to the present invention allows in an advantageous manner to separately control or regulate the proportion of silicone oil, as well as the proportion of water of the mixed emulsion for both sides. Here, only silicone oil concentrate 1 is buffered in a small quantity, but which is sufficient for an exchange of reservoir 2—instead of buffering silicone oil emulsion in a large quantity—thereby requiring only a single buffering container according to the present invention.

It is a particular advantage of the present invention that, due to the device or method, the proportion or allotment of water and the proportion or allotment of silicone oil or silicone oil concentrate in the liquid mixture may be adjusted separately from one another and targeted for each web side according to the print job parameters. The web may thus be accurately wetted and also provided with sufficient silicone.

Furthermore, the device according to the present invention makes it possible to modify the percentage composition of liquid mixture 18 according to printing requirements within a short response time since the mixing tanks—due to the continuous, quasi-continuous, or intermittent inflow of water and silicone oil concentrate—may be designed to have a very small volume or volumetric capacity, approximately one liter for example, compared to that of the buffering container, approximately ten liters, for example.

Both mixing tanks 12, 14 are essentially always filled during operation, for example, because controller 42 controls or regulates an essentially continuous replenishment of mixing tanks 12, 14 and troughs 44, 45 as a function of the signal of float element 54.

Since the proportion of water in liquid mixture 18 constitutes the largest part, in most cases more than approximately 95%, for example, float element 52, in the event of a drop of the level, may operate or trigger the opening of valve 36 directly, so that controller 42 additionally only ensures the appropriate flow of silicone oil concentrate, in order to produce the desired mixture.

Both mixing tanks 12, 14 may be configured in such a way that because of their design alone sufficient mixing of the two liquids takes place when, for example, both liquids are supplied at the bottom of the tank where they mix, while the outflow and thus the supply of troughs 44, 45 takes place via an overflow. However, a mixing element, a stirrer for example, may also be provided in one of mixing tanks 12, 14.

The liquid mixture may flow to troughs 44, 45 by gravity or via pumps.

Although not shown in FIG. 1, those skilled in the art will recognize that the device according to the present invention may also have at least one temperature control device (or one for each side of the web) for liquid mixture 18. Conventional heat exchangers or heating devices lend themselves for this purpose.

Due to the essentially continuous and controlled and/or regulated flow of liquid mixture 18 to both troughs 44, 45, feedbacks from troughs 44, 45 to mixing tanks 12, 14 may be advantageously dispensed with in the design according to the present invention, the device thus having a less complex construction. Also the flow of silicone oil concentrate 1 from reservoir 2 to buffer tank 4 may be essentially continuously (quasi-continuously) controlled and/or regulated by controller 42 so that overflow line 10 may also advantageously be dispensed with. However, overflow line 10 and the feedback of silicone oil concentrate 1 also ensure good mixing or homogenization of the concentrate, so that it may also be advantageous to keep an overflow line 10.

According to the present invention, controller 42 may also be part of the press control and may, for example, be integrated into the central control system of the printing press, of a dryer including an integrated cooling roll stand, or of the cooling roll stand so that a separate controller 42—i.e., a computer or a processor including a memory—may be dispensed with, thereby saving costs.

Furthermore, according to an embodiment the operator may have the option to manually adapt the setpoint values for WA1, WA2, SA1, and SA2 of the current print job, so that these improved values may be stored in memory unit 58 for presetting for future print jobs.

Due to the small size (volumetric capacity) of buffer tank 4 and mixing tanks 12, 14, they may also be integrated into the cooling roll stand, thereby saving additional installation space and costs.

Supply source 32 may be implemented in the form of a common water connection.

LIST OF REFERENCE NUMBERS

1 first liquid/silicone oil concentrate
2 reservoir
4 buffer tank
6 supply line
8 pump
10 overflow line
12 mixing tank
14 mixing tank
16 second liquid/water
18 liquid mixture
20 applicator
22 applicator
24 material web/printing material web
26 supply line
28 supply line
30 supply line
32 supply source
34 pressure control valve
36 valve
38 valve
40 warning device
42 regulating and/or control unit/controller
44 container/trough
44*a* section
44*b* section
45 container/trough
46 applicator roll

48 motor
50 measuring vessel
52 communicating line
54 float element
56 signal and/or data line
58 memory unit
60 processor
66 supply line
68 supply line
70 flow limiter
72 flow limiter
74 valve
76 valve
78 signal and/or data line
80 signal and/or data line
82 signal and/or data line
84 hot air dryer
86 cooling roll
88 cooling roll
90 cooling roll
92 moving direction
94 moisture

What is claimed is:

1. A printing press comprising:

at least one printing unit for printing a web-shaped printing material;

a device for applying a liquid mixture of a silicone oil concentrate and at least water to the web-shaped printing material; and a cooling roll for the web-shaped printing material;

the device for applying a liquid mixture including:

a reservoir for the silicone oil concentrate;

a supply source for the water;

a mixing tank for the silicone oil concentrate and the water;

an applicator for transferring the liquid mixture onto the printing material, the applicator having at least one container for the liquid mixture and a float element or a fill level sensor connected to a control unit and/or regulating unit for signal transmission and/or data transmission as a function of a fill level, a buffer tank for the silicone oil concentrate separated from the mixing tank, the buffer tank receiving the silicone oil concentrate from the reservoir; and a supply line from the buffer tank to the mixing tank and a valve in the supply line operated by the control unit and/or regulating unit so that a continuous, or quasi-continuous, or intermittent flow of the silicone oil concentrate is produced.

2. A printing press comprising:

at least one printing unit for printing a web-shaped printing material;

a device for applying a liquid mixture of a silicone oil concentrate and at least water to the web-shaped printing material; and a cooling roll for the web-shaped printing material;

the device for applying a liquid mixture including:

a reservoir for the silicone oil concentrate;

a supply source for the water;

a mixing tank for the silicone oil concentrate and the water;

an applicator for transferring the liquid mixture onto the printing material, the applicator having at least one container for the liquid mixture designed as a trough, the applicator including an applicator roll transferring the liquid mixture from the trough onto the printing material; and a buffer tank for the silicone oil concentrate separated from the mixing tank, the buffer tank receiving the silicone oil concentrate from the reservoir.

3. The printing press as recited in claim 2 wherein the device further includes a motor, and the applicator roll is driven by the motor, the motor being controlled and/or regulated by a control unit and/or regulating unit in such a way that the rotational speed of the applicator roll is modifiable.

4. A printing press comprising:

at least one printing unit for printing a web-shaped printing material;

a device for applying a liquid mixture of a silicone oil concentrate and at least water to the web-shaped printing material; and a cooling roll for the web-shaped printing material;

the device for applying a liquid mixture including:

a reservoir for the silicone oil concentrate;

a supply source for the water;

a mixing tank for the silicone oil concentrate and the water;

an applicator for transferring the liquid mixture onto the printing material, the applicator having at least one container for the liquid mixture, the applicator including a roll contacting the container; and a buffer tank for the silicone oil concentrate separated from the mixing tank, the buffer tank receiving the silicone oil concentrate from the reservoir.

* * * * *